US011197535B2

(12) United States Patent
Lewis

(10) Patent No.: US 11,197,535 B2
(45) Date of Patent: Dec. 14, 2021

(54) FLAG FOOTBALL SYSTEM

(71) Applicant: AFFL ASSOCIATES, LLC, New York, NY (US)

(72) Inventor: Jeffrey Lewis, New York, NY (US)

(73) Assignee: AFFL ASSOCIATES, LLC, New York, NY (US)

( * ) Notice: Subject to any disclaimer, the term of this patent is extended or adjusted under 35 U.S.C. 154(b) by 0 days.

(21) Appl. No.: 16/989,061

(22) Filed: Aug. 10, 2020

(65) Prior Publication Data

US 2021/0153634 A1 May 27, 2021

Related U.S. Application Data

(62) Division of application No. 15/945,496, filed on Apr. 4, 2018, now Pat. No. 10,736,409.

(Continued)

(51) Int. Cl.

*A63B 71/00* (2006.01)
*A45F 5/02* (2006.01)

(Continued)

(52) U.S. Cl.

CPC ..... *A45F 5/021* (2013.01); *A45F 5/02* (2013.01); *A63B 67/00* (2013.01); *A63B 71/06* (2013.01); *A63B 71/0605* (2013.01); *A44D 2203/00* (2013.01); *A63B 2071/0602* (2013.01); *A63B 2071/0694* (2013.01); *A63B 2209/08* (2013.01);

(Continued)

(58) Field of Classification Search

CPC ..... A45F 5/021; A45F 5/02; A63B 67/00; A63B 71/06; A63B 71/0605; A63B 2225/74; A63B 2071/0602; A63B 2071/0694; A63B 2209/08; A63B 2243/007; A44D 2203/00

USPC ..... 473/502, 450, 458, 464, 415, 422; 273/459; 2/1, 69, 102

See application file for complete search history.

(56) References Cited

U.S. PATENT DOCUMENTS 6,846,254 B2 * 1/2005 Baxter ..... A63B 69/0059 473/450
7,076,279 B2 * 7/2006 Tabata ..... A42B 3/303 455/575.1

(Continued)

OTHER PUBLICATIONS

Lewis, U.S. Office Action dated Aug. 22, 2019 directed to U.S. Appl. No. 15/945,496; 8 pages.

*Primary Examiner* — Mitra Aryanpour
(74) *Attorney, Agent, or Firm* — Morrison & Foerster LLP

(57) ABSTRACT

Systems and methods described herein may provide an adjustable magnetic attachment force for flag football and for determining a location in flag football. In some embodiments, a system comprises a flag and a wearable item, wherein the flag and the wearable item are configured such that a magnetic attachment force exerted between a first connector and a second connector attaches the flag to the wearable item. In some embodiments, a set comprises one or more flags and one or more wearable items, wherein an adjustable magnetic attachment force attaching the flags and wearable items is adjusted by replacing one or more magnetic components. In some embodiments, a system comprising a flag and a wearable item is configured to detect that contact between a first connector and a second connector has been broken and to automatically indicate a location associated with the contact being broken.

10 Claims, 11 Drawing Sheets

Related U.S. Application Data

(60) Provisional application No. 62/482,481, filed on Apr. 6, 2017, provisional application No. 62/561,865, filed on Sep. 22, 2017.

(51) Int. Cl.
*A63B 71/06* (2006.01)
*A63B 67/00* (2006.01)

(52) U.S. Cl.
CPC ..... *A63B 2225/74* (2020.08); *A63B 2243/007* (2013.01)

(56) References Cited

U.S. PATENT DOCUMENTS 7,085,120 B2 * 8/2006 Kraz ..... A61N 1/14 361/220
7,288,035 B2 10/2007 Young, Jr.
7,301,648 B2 * 11/2007 Foxlin ..... G02B 27/017 356/620
7,891,231 B2 * 2/2011 Song ..... A63B 71/0605 73/12.09
8,052,546 B1 * 11/2011 Nagel ..... A63B 69/0071 473/450
9,242,159 B1 * 1/2016 Lacoste ..... A63B 21/4015 473/458
9,414,651 B2 8/2016 Proud et al.
9,420,856 B2 8/2016 Proud et al.
9,553,486 B2 1/2017 Proud et al.
9,560,725 B2 * 1/2017 Wilson ..... F21V 33/008 476/465
9,662,015 B2 5/2017 Proud et al.
9,704,209 B2 7/2017 Proud et al.
10,058,761 B2 * 8/2018 Thompson ..... H04W 4/80
10,086,250 B2 * 10/2018 Wright ..... G09B 19/0038 473/464
10,114,342 B2 10/2018 Kim et al.
10,139,282 B2 11/2018 Chrostowski
10,146,323 B1 12/2018 Keyes et al.
10,198,030 B2 2/2019 Burch
10,201,089 B2 2/2019 Huitema et al.
10,213,647 B2 2/2019 Balakrishnan et al.
10,500,472 B1 * 12/2019 Davis ..... H05K 1/092
10,687,514 B2 * 6/2020 Sheldon ..... H02J 13/00026
10,736,409 B2 * 8/2020 Lewis ..... A63B 67/00 473/502
2005/0143199 A1 * 6/2005 Saroyan ..... A63B 71/0605 473/438
2008/0139345 A1 6/2008 Baun et al.
2009/0042675 A1 2/2009 Baun, II et al.
2010/0161084 A1 * 6/2010 Zhao ..... G06F 3/0346 700/85
2011/0251802 A1 10/2011 Song
2016/0324442 A1 11/2016 Zdeblick
2017/0232317 A1 8/2017 Ling
2018/0220623 A1 8/2018 Chu
2019/0240559 A1 * 8/2019 Lewis ..... A63B 71/0605
2019/0356941 A1 * 11/2019 Sullivan ..... G06F 3/1446
2020/0139217 A1 * 5/2020 Lewis ..... A63B 71/0622
2021/0220720 A1 * 7/2021 Harriger ..... G01C 9/02

* cited by examiner

FLAG FOOTBALL SYSTEM

CROSS-REFERENCE TO RELATED APPLICATIONS

This application is a divisional of U.S. application Ser. No. 15/945,496, filed Apr. 4, 2018, which claims the priority of U.S. Provisional Application Nos. 62/482,481, filed Apr. 6, 2017, and 62/561,865 filed Sep. 22, 2017, the entire contents of each of which are incorporated herein by reference

FIELD OF THE DISCLOSURE

This disclosure relates generally to flag football equipment and, more specifically, to attaching flags to wearable items and to automatically determining locations associated with flag football equipment

BACKGROUND OF THE DISCLOSURE

Flag football is a type of gridiron football (American football) in which players wear flags that are attached to belts worn around the waist. The flags are attached in such a manner that they can be removed by the application of force; known means of attachment include attachment by friction, suction, or hook and loop fastener material. When a player on the defense grabs and pulls on the flag of an offensive player who is advancing the ball, the flag detaches from the offensive player's belt, play is halted, and a referee assesses the position at which the flag was detached in order to spot the ball in accordance with that position before the next play.

Flag football may provide a safer alternative to tackle football, because high-impact collisions are not an integral part of the game. Furthermore, the ball in flag football may be spotted at the position of the flag when it is detached from a belt, rather than at a position of the ball when the flag is detached from the belt; this may discourage headfirst diving (and/or facilitate the rules of flag football banning the practice), mitigating the risk of dangerous headfirst collisions.

SUMMARY OF THE DISCLOSURE

As described above, flag football may provide a safer alternative to tackle football in which players are marked down in accordance with flags being pulled from their belts, rather than in accordance with being tackled.

However, known methods and systems in flag football for attaching flags to belts are susceptible to wear, degradation, inconsistent attachment force that may degrade or change unpredictably over time, and inconsistent performance in inclement weather. For example, hook and loop fasteners may wear down over time, and friction or suction based attachment means may provide decreased or inconsistent attachment force when equipment is wet from rain. Furthermore, known methods and systems for attaching flags to belts do not allow users to easily monitor and/or adjust the force by which flags are attached to belts. For example, known methods for attachment of flags to belts, such as by hook-and-loop fasteners, may provide inconsistent attachment force each time the flag is detached and reattached, in accordance with the precise placement of the hook-and-loop attachment materials and in accordance with how hard a user presses the materials together. Furthermore, known methods for attachment of flags to belts may provide a fixed attachment force that is not configured to be intentionally and precisely varied and adjusted, and may therefore be unsuitable for use by players of different age groups or across different leagues requiring different attachment force.

Thus, there is a need for improved flag football equipment and for improved systems and methods for reliably and adjustably attaching flags for flag football, such that a very precise attachment force may be selected and reliably achieved over time and over many successive attachments and detachments of the equipment. In some embodiments, this need may be addressed by using an adjustable magnetic attachment force to attach flag football equipment. As described herein, placing a magnetic component in one or both of a flag-side connector and a belt/garment-side connector may allow for a very precise magnetic attachment force to be calculated beforehand and reliably achieved over successive attachments and attachments. This magnetic attachment force may be very precisely adjustable by, for example, replacing one or more of the magnets in the flag and/or belt/garment with another magnet having a different size, shape, magnetic grade, and/or magnetic flux output per unit volume (e.g., a stronger magnet will have a higher magnetic flux output per unit volume). Furthermore, known methods and systems in flag football for determining a position of a player and/or flag at the time that the flag is pulled from the belt are inconsistent, inaccurate, and expensive or arduous to implement. For example, the most common method for determining a location at which a flag was detached from a belt is for a human referee to visually estimate the location based on observation of the game. This requires the presence and time of one or more human referees and also introduces the possibility of human error every time that the ball needs to be spotted in a game. Accordingly, there is a need for improved systems and methods for accurately, quickly, reliably, and efficiently determining a precise location at which a flag and/or player is located when a flag is detached from the player's belt. In some embodiments, this need may be addressed by using one or more sensors disposed in a flag connector and/or a belt connector to detect when a flag has been detached from a belt/garment, and to automatically determine a location of the flag, belt, or player at the time of the detachment in response to detecting the detachment. The location may be determined at or transmitted to one or more players or officials, such that a precise location at which the detachment occurred, and a precise location at which the ball should be spotted before the next play, may be known.

Thus, there is a need for systems, methods, and techniques for reliably, accurately, and efficiently determining a location of a player at a time at which a flag is detached from a wearable item. In some embodiments, a first system for attaching a flag to a wearable item is provided, comprising: a flag comprising a first connector, wherein the first connector comprises a first magnetic portion; and a wearable item comprising a second connector, wherein the second connector comprises a second magnetic portion; wherein the flag and the wearable item are configured such that a magnetic attachment force exerted between the first connector and the second connector attaches the flag to the wearable item.

In some embodiments of the first system, the flag comprises a distal end and a proximal end, and the first connector is located near the proximal end of the flag.

In some embodiments of the first system, wherein the wearable item is a belt configured to be worn around a waist of a user.

In some embodiments of the first system, the wearable item is a piece of clothing configured to be worn by a user.

In some embodiments of the first system: the wearable item is pants and shorts; and the second connector is located near a waistband of the pants or shorts.

In some embodiments of the first system, the first magnetic portion is disposed beneath an external layer of the flag; and the second magnetic portion is disposed beneath an external layer of the wearable item.

In some embodiments of the first system, the first magnetic portion and the second magnetic portion are disposed respectively upon the flag and the wearable item such that the first magnetic portion and the second magnetic portion are in direct contact with one another when the magnetic attachment force is exerted between them.

In some embodiments, a set for of flags and wearable items is provided, comprising: one or more flags; and one or more wearable items; wherein one or more of the flags are attachable to one or more of the wearable items by an adjustable magnetic attachment force.

In some embodiments of the set: a first one of the one or more flags is attached to a first magnetic connector; a first one of the one or more wearable items is attached to a second magnetic connector; and the adjustable magnetic attachment force is adjustable by replacing the first magnetic connector with a third magnetic connector, wherein a first instantaneous magnetic attachment force between the first magnetic connector and the second magnetic connector is different from a second instantaneous magnetic attachment force between the third magnetic connector and the second magnetic connector.

In some embodiments of the set, the third magnetic connector is attached to a second one of the one or more flags.

In some embodiments of the set: the first magnetic connectors is removable from the first one of one or more flags; and the third magnetic connector is attachable to the first one of the one or more flags.

In some embodiments of the set: a first one of the one or more flags is attached to a first magnetic connector; a first one of the one or more wearable items is attached to a second magnetic connector; and the adjustable magnetic attachment force is adjustable by replacing the second magnetic connector with a fourth magnetic connector, wherein a first instantaneous magnetic attachment force between the first magnetic connector and the second magnetic connector is different from a third instantaneous magnetic attachment force between the first magnetic connector and the fourth magnetic connector.

In some embodiments of the set, the fourth magnetic connector is attached to a second one of the one or more wearable items.

In some embodiments of the set: the second magnetic connectors is removable from the first one of one or more wearable items; and the fourth magnetic connector is attachable to the first one of the one or more wearable items.

In some embodiments of the set: a first one of the one or more flags is attached to a first magnetic connector; a first one of the one or more wearable items is attached to a second magnetic connector; and the adjustable magnetic attachment force is adjustable by increasing or decreasing a magnetization of at least one of the first magnetic connector and the second magnetic connector.

In some embodiments, a second system, for monitoring flag football equipment, is provided, comprising: a flag comprising a first connector, the first connector comprising a first magnetic portion; and a wearable item comprising a second connector, the second connector comprising a second magnetic portion; one or more processors; memory storing instructions that, when executed by the one or more processors, cause the one or more processors to: detect that contact between the first connector and the second connector has been broken.

In some embodiments of the second system, the instructions further cause the one or more processors to, in response to detecting that the contact has been broken, generate and transmit a signal indicating that the contact has been broken.

In some embodiments of the second system, the system further comprises an output device, and the instructions further cause the one or more processors to: determine a location associated with the breaking of the connection of the first connector and the second connector, in response to detecting that the contact has been severed; output an indication indicating the determined location.

In some embodiments of the second system, before contact between the first connector and the second connector is broken: the first connector and the second connector are magnetically attached by a magnetic attachment force exerted between the first magnetic portion and the second magnetic portion; and the first connector and the second connector are in electrical contact with one another; and detecting that contact between the first connector and the second connector has been broken comprises detecting that the electrical contact has been broken.

In some embodiments, a method for monitoring flag football equipment is provided, comprising: detecting, by one or more processors, that contact between a first connector associated with a flag and a second connector associated with a wearable item has been broken; wherein the first connector comprises a first magnetic portion and the second connector comprises a second magnetic portion.

In some embodiments of the method, the method comprises, in response to detecting that the contact has been broken, generating and transmitting a signal indicating that the contact has been broken.

In some embodiments of the method, the method comprises: determining a location associated with the breaking of the connection of the first connector and the second connector, in response to detecting that the contact has been severed; and outputting, by an output device of the system, an indication indicating the determined location.

In some embodiments of the method: before contact between the first connector and the second connector is broken: the first connector and the second connector are magnetically attached by a magnetic attachment force exerted between the first magnetic portion and the second magnetic portion; and the first connector and the second connector are in electrical contact with one another; and detecting that contact between the first connector and the second connector has been broken comprises detecting that the electrical contact has been broken.

In some embodiments, a non-transitory computer-readable storage medium storing instructions for monitoring flag football equipment is provided, wherein the instructions are executable by the one or more processors to cause the one or more processors to: detect that contact between a first connector associated with a flag and a second connector associated with a wearable item has been broken, wherein the first connector comprises a first magnetic portion and the second connector comprises a second magnetic portion.

In some embodiments of the non-transitory computer-readable storage medium, the instructions further cause the one or more processors to, in response to detecting that the contact has been broken, generate and transmit a signal indicating that the contact has been broken.

In some embodiments of the non-transitory computer-readable storage medium, the instructions further cause the one or more processors to: determine a location associated with the breaking of the connection of the first connector and the second connector, in response to detecting that the contact has been severed; and output, by an output device of the system, an indication indicating the determined location.

In some embodiments of the non-transitory computer-readable storage medium: before contact between the first connector and the second connector is broken: the first connector and the second connector are magnetically attached by a magnetic attachment force exerted between the first magnetic portion and the second magnetic portion; and the first connector and the second connector are in electrical contact with one another; and detecting that contact between the first connector and the second connector has been broken comprises detecting that the electrical contact has been broken.

BRIEF DESCRIPTION OF THE FIGURES

The foregoing summary, as well as the following detailed description of embodiments, is better understood when read in conjunction with the appended drawings. For the purpose of illustrating the present disclosure, the drawings show exemplary embodiments of the disclosure; the disclosure, however, is not limited to the specific methods and instrumentalities disclosed. In the drawings.

DETAILED DESCRIPTION OF THE DISCLOSURE

Described herein are systems and methods for adjustably attaching flags to wearable items, as well as systems and methods for determining a location of a player at a time at which a flag is detached from a wearable item.

Figure 1A:
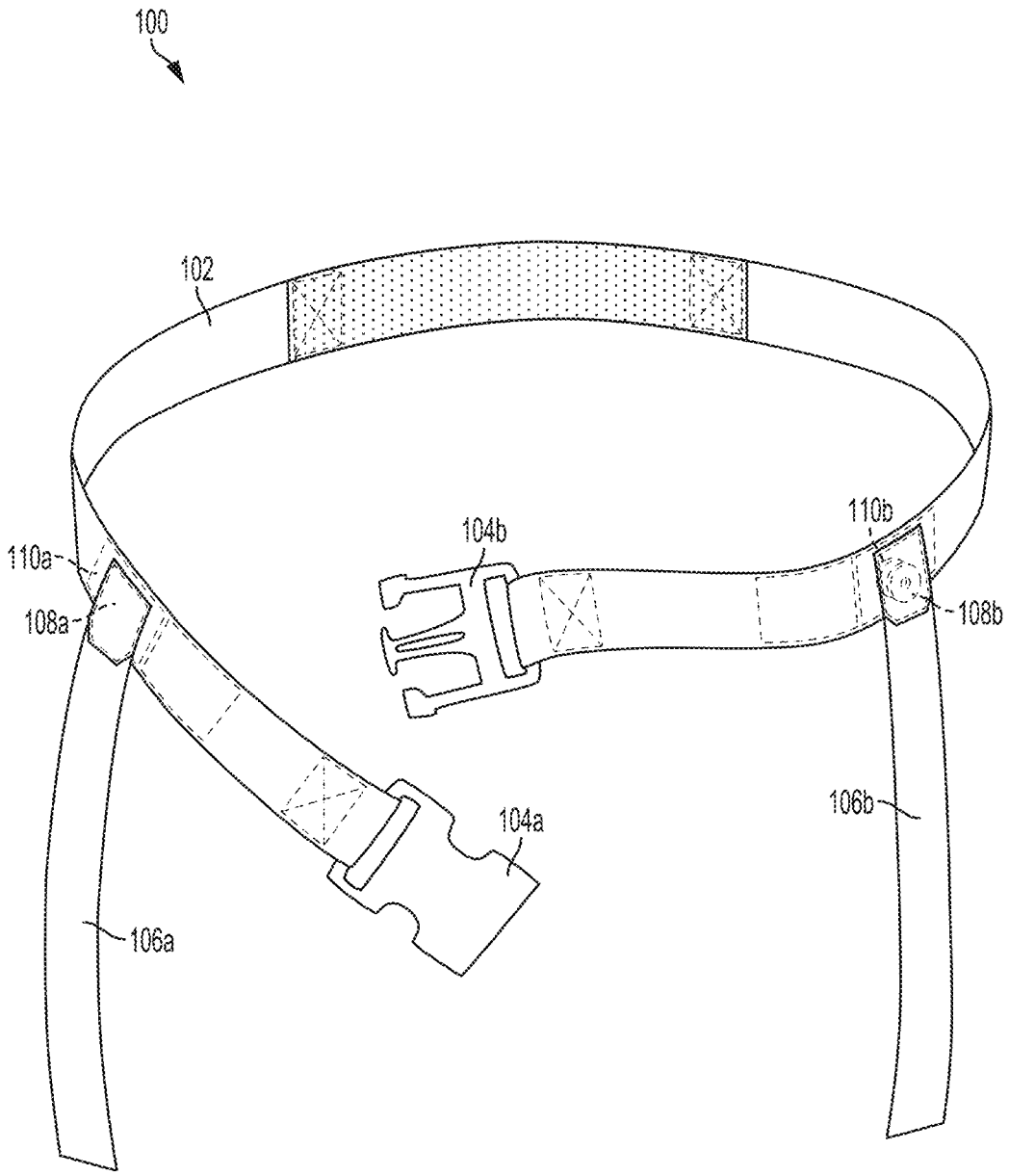
FIG. 1A illustrates a belt and flag assembly in accordance with some embodiments.

FIG. 1A illustrates a belt and flag assembly in accordance with some embodiments. The belt and flag assembly 100 depicted in FIG. 1A comprises belt 102 and flags 106*a* and 106*b*. Belt and flag assembly 100 may be used in playing flag football, such that the belt may be worn by a player and the flags may be grasped and pulled from the belt by an opposing player.

In some embodiments, belt 102 may comprise any suitable organic material, synthetic material, fabric, plastic material, vinyl material, metallic material, blend, or combination thereof. Belt 102 may be constructed to be flexible and lightweight (e.g., less than 1 pound, less than 0.1 pounds, or less than 0.05 pounds), such that it may be worn around a player's waist. In some embodiments, belt 102 may be elastic, such that it may fit tightly about the waist of a player—this may be advantageous because a tight fit may prevent the risk that an opposing player, in attempting to grasp flag 106*a* or 106*b*, accidentally grasps belt 102 itself.

Belt 102 may, in some embodiments, include fasteners 104*a* and 104*b*, which may be a clasp, fastener, or connector configured to connect the ends of belt 102 to one another when it is placed around a player's waist. In some embodiments, fasteners 104*a* and 104*b* may join together with at attachment force that exceeds attachment forces attaching flags 106*a* and 106*b* to belt 102. In this way, when one of flags 106*a* or 106*b* is pulled, the flag will detach from belt 102 before the connection of fasteners 106*a* and 106*b* is broken. In some embodiments, the attachment force of fasteners 104*a* and 104*b* to one another may be more than two times, three times, five times, or ten times greater than the attachment force of flag 106*a* or flag 106*b* to belt 102.

In some embodiments, flags 106*a* and 106*b* may respectively comprise connectors 108*a* and 108*b*. Connectors 110 may be located at a proximal end of flags 106, such as being located at or close to the near end of a rectangular-shaped flag, as depicted in the example of FIG. 1A. In some embodiments, connectors 108*a* and 108*b* may be configured to respectively (and/or interchangeably) attach to connectors 110*a* and 110*b*, which may be located on belt 102. In some embodiments, belt 102 may be configured such that connectors 110*a* and 110*b* are located at or near a player's hips when belt 102 is worn by the player. While the embodiment of belt and flag assembly 100 depicted in FIG. 1 shows two flags connected to two connectors on a belt, other arrangements may have fewer flags, fewer connectors, more flags, more connectors, or any combination thereof.

In some embodiments, connectors 108 and 110 may comprise mechanical connection means or components, such as friction-based connection components or suction-based components. For example, connectors 108 and 110 may comprise one or more of clasps, suction cups, hook and loop fasteners, hooks, springs, buttons, snaps, or any suitable combination thereof.

In some embodiments, connectors 108 and 110 may comprise magnetic attachment means or components configured to allow connectors 108 and 110 to exert a magnetic force on one another. In some embodiments, connectors 108 and 110 may be magnetic connectors. In some embodiments, as explained further below, connectors 108 and 110 may be adjustable magnetic connectors. In some embodiments in which a connector is a magnetic connector or an adjustable magnetic connector, the connector may comprise a magnetic component comprising magnetic material. A magnetic component may comprise magnetized material in some embodiments. In some embodiments, the magnetic component may be a magnet, electromagnet, rechargeable magnet, or any other suitable magnetized and/or magnetizable material. In some embodiments, the magnetic component may comprise neodymium magnetic material, may comprise ceramic magnetic material, and/or may comprise rare-earth magnetic material.

In some embodiments, for example as shown below in FIG. 4, the magnetic component may be circular or substantially circular in shape. A circular shape may be advantageous because it may allow one or more magnetic components to rotate without becoming misaligned from a predefined orientation in which a consistent magnetic attachment force will be exerted; that is, the predefined position may be independent of rotation of a magnetic component about at least one axis when the magnetic component is circular in shape.

In some embodiments, a magnetic component may be disposed on the surface of a flag, belt, or connector, or it may otherwise be attached to the exterior of a flag, belt, or connector, such that the magnetic component is exposed and may be placed into direct contact with another magnetic component. In some embodiments, a magnetic component may be enclosed inside a housing, or may be placed completely or partially behind one of more layers, such as a layer of fabric or plastic material, or may be otherwise contained in an interior of a flag, belt, or connector, such that the magnetic component is not exposed and may not be placed into direct contact with another magnetic component.

Since magnetic force between two magnetic objects is inversely proportional to the square of the distance between the magnetic objects, the magnetic force between connectors 108 and 110 may be dependent on the arrangement of connectors 108 and 110, including the distance between connectors 108 and 110.

In some embodiments, when a flag and belt, and the magnetic connectors included therein, are connected in a predefined arrangement including a predefined distance (e.g., connectors 108*a* and 110*a* are touching one another), a magnetic force exerted between the magnetic connectors (at the predefined distance) may be referred to as a magnetic attachment force. The magnetic attachment force thus may be the greatest magnetic attraction force that is exerted between two connectors and may be the magnetic force that is exerted between them when they are placed in direct contact or very near to one another in a manner that is considered an attached and/or connected arrangement. In the example of FIG. 1A, flags 106*a* and 106*b* and belt 102 are depicted in an arrangement such that connector 108*a* is in contact with connector 110*a* and connector 108*b* is in contact with connector 110*b*, such that a magnetic connection force is exerted between the depicted pairs of connectors.

Figure 1B:
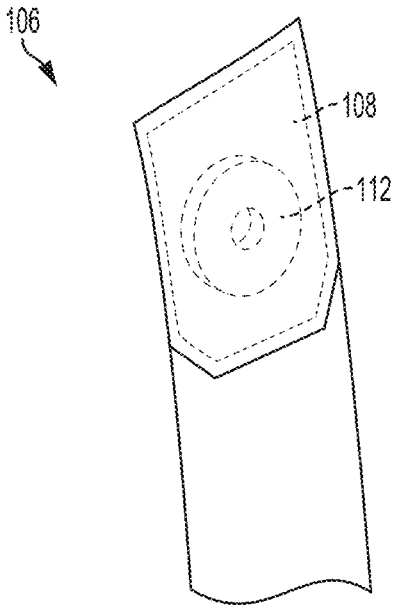
FIG. 1B illustrates a flag connector in accordance with some embodiments.

FIG. 1B illustrates flag 106, which may be either one of flags 106*a* and 106*b* as described above with reference to FIG. 1A, in accordance with some embodiments. As shown in FIG. 1B, flag 106 comprises connector 108, which may be either one of connectors 108*a* and 108*b* described above with reference to FIG. 1A, disposed near a proximal end of flag 106. In the depicted embodiment, connector 108 is a magnetic connector that includes magnetic component 112. Magnetic component 112 may comprise magnetic material and/or magnetized material. In the depicted embodiment, magnetic component 112 is disposed between outer layers of flag 106 and is sewn into place so that it cannot move from connector 108 at the proximal end of flag 106. In some embodiments, magnetic component 112 may be contained in an interior portion of connector 108 or may be disposed or attached to an exterior or exposed portion of connector 108. In some embodiments, placing magnetic component 112 in an interior portion of connector 108 may be advantageous because it may prevent or discourage tampering.

Figure 1C:
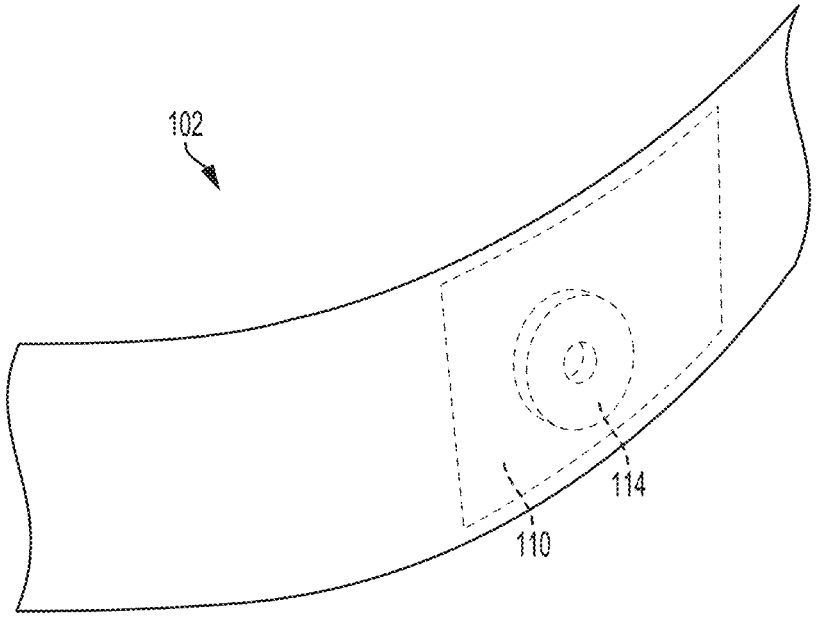
FIG. 1C illustrates a belt connector in accordance with some embodiments.

FIG. 1C illustrates a detail view of belt 102, as described above with reference to FIG. 1A, in accordance with some embodiments. As shown in FIG. 1C, belt 102 comprises connector 110, which may be either one of connectors 110*a* and 110*b* described above with reference to FIG. 1A. In the depicted embodiment, connector 110 is a magnetic connector that includes magnetic component 114. Magnetic component 114 may comprise magnetic material and/or magnetized material. In the depicted embodiment, magnetic component 114 is disposed between outer layers of belt 102 and is sewn into place so that it cannot move from connector 110. In some embodiments, magnetic component 114 may be contained in an interior portion of connector 110 or may be disposed or attached to an exterior or exposed portion of connector 110. In some embodiments, placing magnetic component 114 in an interior portion of connector 110 may be advantageous because it may prevent or discourage tampering.

Figure 2A:
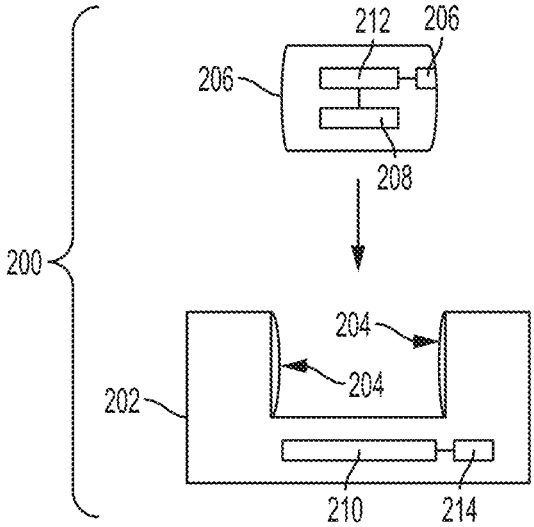
FIGS. 2A and 2B illustrate a connector assembly in accordance with some embodiments.

FIG. 2A depicts a connector assembly in accordance with some embodiments. In some embodiments, a connector assembly comprises belt-side connector 202 and flag side connector 206, which may be configured to connect to one another in order to attach a flag to a belt. In some embodiments, belt-side connector 202 may be included in or may constitute one or both of connectors 110*a* and 110*b* as described with reference to FIG. 1A, while flag-side connector 206 may be included in or may constitute one or both of connectors 108*a* and 108*b* as described with reference to FIG. 1A.

In some embodiments, connector 202 may comprise magnetic component 210, and connector 206 may comprise magnetic component 208. One or both of magnetic component 208 and magnetic component 210 may have one or more of the characteristics of magnetic components 112 and 114, respectively, as discussed above with respect to FIGS. 1B and 1C. In the embodiment shown in FIG. 2A, magnetic components 208 and 210 are encased in a housing and are thus located in an interior portion of connectors 206 and 202, respectively.

Connector assembly 200 may thus be a magnetic connector (that may be an adjustable magnetic connector or may be a part of an adjustable magnetic connection system) comprising connectors 202 and 206 that exert an attractive magnetic force on one another. Similar to as discussed above with reference to FIG. 1A, connectors 202 and 206 may exert a magnetic attachment force on one another when the connectors are arranged and configured in a predefined arrangement, such as in contact with one another as shown in FIG. 2B.

Figure 2B:
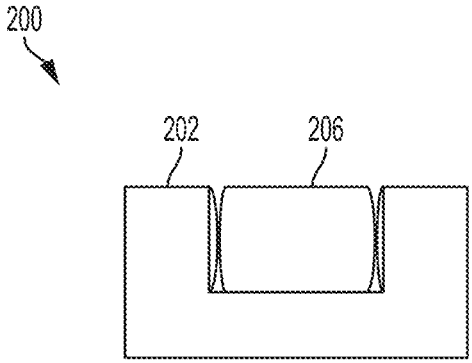

In some embodiments, connector 202 may have a cup shape like the shape depicted in FIG. 2B, and connector 206 may have a cylindrical shape like the shape depicted in FIG. 2B, such that connector 206 may be configured to slide into connector 202 in order for the connectors to achieve the predefined orientation in which the magnetic attachment force may be achieved.

In some embodiments, connector 202 may comprise contact element 204, which may be an element such as a spring, clip, or any protruding, deformable, depressible, or actuatable element configured to extend inward into the opening of the cup-shaped connector 202, and configured to contact and/or exert force on connector 206 when it is inserted into connector 202 as shown in FIG. 2B. Contact element 204 may accordingly contact and/or exert force on connector 206 when it is inserted into connector 202, which may provide an additional attachment force in addition to the magnetic attachment force. In some embodiments, connector 202 may comprise more than one contact element having some or all of the features described herein with respect to contact element 202.

In some embodiments, contact element 202 may be configured to facilitate electronic communication between connector 202 and connector 206. For example, in some embodiments, contact element 202 may comprise a conductive material that is configured to complete a circuit when in contact with connector 206. In some embodiments, contact element 202 may comprise any suitable electrical connector configured to complete any number of circuits and to enable the sending and receiving of any number of electronic signals between connector 202 and connector 204. For example, contact element 204 may comprise one or more crimp-on connectors, one or more plug-and-socket connectors, one or more blade connectors, one or more ring and spade terminals, and/or one or more other types of electrical connectors.

Connector 202 may be configured to use the one or more electrical connectors in contact element 202 in order to send and/or receive one or more signals to and/or from connector 206, wherein the one or more signals may be used to determine whether contact is maintained or contact has been broken/severed between connector 202 and connector 206. Determining whether contact has been broken between connector 202 and connector 206 may be used, as will be explained in greater detail below, to determine whether a flag has been pulled from a belt of a player and to determine a time and location at which the flag was removed.

In some embodiments, electronic signals may be sent through contact element 204 and received by a processing unit outside connector 202, and in some embodiments electronic signals may be received through contact element 204 from a processing unit outside connector 202. In some embodiments, a processing unit in connector 202 may send signals out through contact element 204, and that signal may be received or detected by the same processing unit (e.g., without intermediate processing by another processing unit). For example, a circuit may be completed that flows out through contact element 204, and a processing unit in connector 202 may monitor the circuit and detect whether it is completed to determine whether contact is maintained or contact has been broken/severed between connector 202 and connector 206.

In some embodiments, connector 202 comprises processing unit 214, which may contain one or more processors, memories, input devices, output devices, network communication devices, sensors, and/or power sources. Processing unit 214 may be in electronic communication with contact element 204 and may store and execute instructions configured to determine whether a flag has been pulled from a belt of a player and to determine a time and location at which the flag was removed. In some embodiments, processing unit 214 may be configured to send signals to, receive signals from, and or cause power to be delivered to magnetic component 210, so as to monitor and/or adjust the magnetization of magnetic component 210 to magnetize magnetic component 208.

In some embodiments, connector 206 comprises processing unit 212, which may contain one or more processors, memories, input devices, output devices, network communication devices, sensors, and/or power sources. Processing unit 212 may be in electronic communication with a contact element included in connector 206 (e.g., a contact element that contacts and sends or exchanges electronic signals with or via contact element 204) and may store and execute instructions configured to determine whether a flag has been pulled from a belt of a player and to determine a time and location at which the flag was removed. In some embodiments, processing unit 212 may be configured to send signals to, receive signals from, and/or cause power to be delivered to magnetic component 208, so as to monitor and/or adjust the magnetization of magnetic component 208 to magnetize magnetic component 208.

FIG. 2B illustrates assembly 200 with connectors 202 and connector 206 arranged and configured with respect to one another in the attached/connected position, with connector 202 inside connector 206. As mentioned above, this arrangement may be a predefined arrangement in which the connectors exert the magnetic attachment force on one another. Furthermore, this arrangement may be an arrangement in which one or more components of connectors 202 and 206 complete one or more circuits or electrical connections with one another, such that electronic signals may be sent between the connectors in order to establish that the connectors are in the predefined attached position.

Figure 3A:
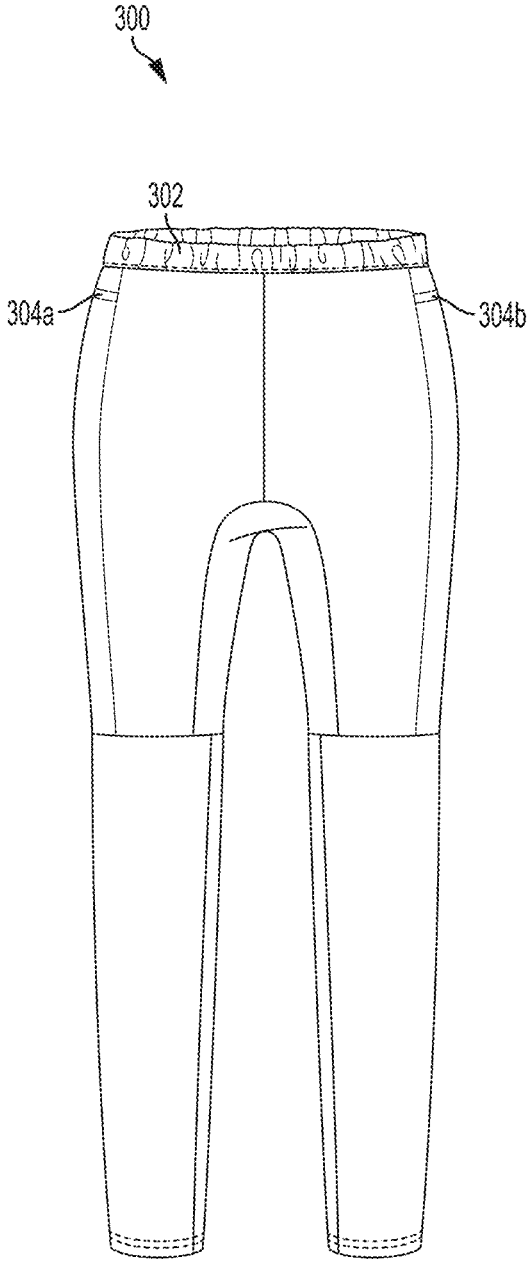
FIGS. 3A-3C illustrate a wearable item for adjustably attaching a flag in accordance with some embodiments.
Figure 3B:
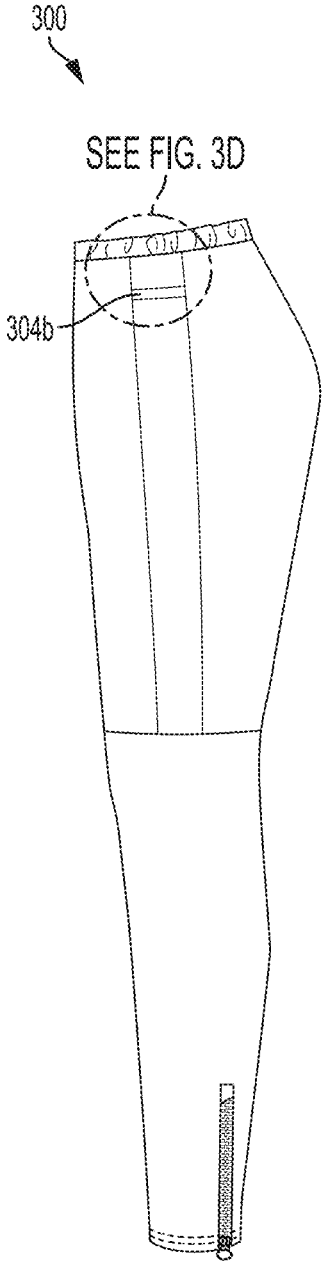
Figure 3C:
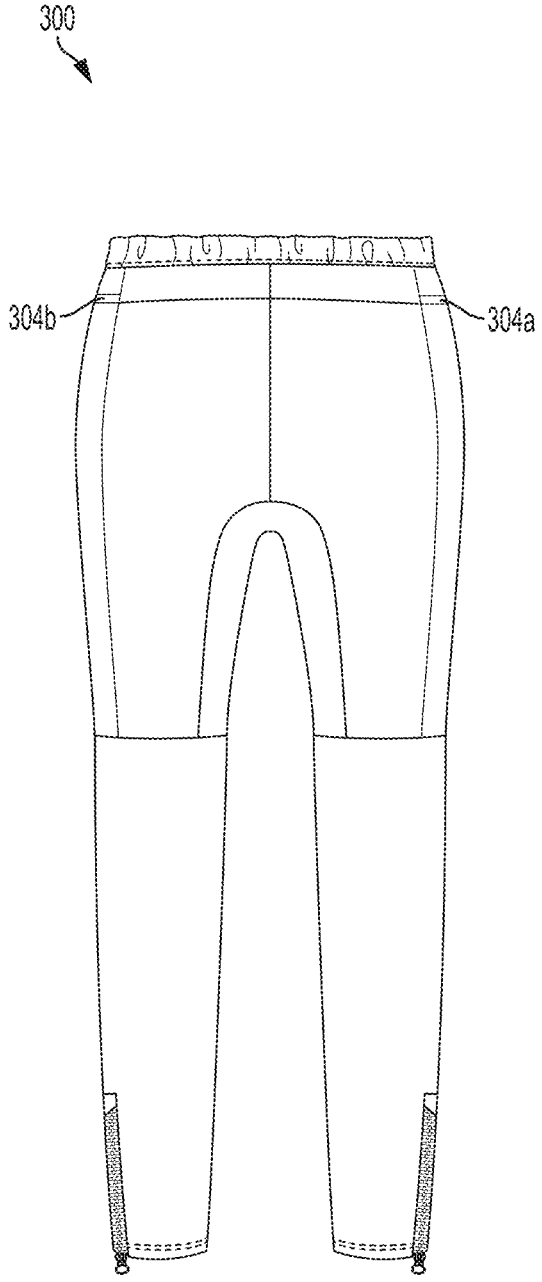

FIGS. 3A-3C illustrate a wearable item 300 in accordance with some embodiments. In the depicted embodiment, wearable item 300 is a pair of pants configured for use with flag football equipment including magnets and flags. FIG. 3A illustrates a front view of wearable item 300; FIG. 3B illustrates a side view of wearable item 300; and FIG. 3C illustrates a rear view of wearable item 300. In some embodiments, the wearable item may be shorts, pants, leggings, skirts, skorts, shirts, jerseys, pinnies, or any athletic garment having one or more of the qualities or characteristics described herein regarding use with flag football equipment including magnets and flags. In some embodiments, the wearable item may comprise any one or more suitable fabrics or materials for use in garments, including elastic materials that may make the garment tight-fitting and therefore reduce the risk that flag football players may inadvertently grasp the garment when attempting to grasp a flag.

In some embodiments, wearable item 300 may be used in place of, or in addition to, a belt in flag football. In some embodiments, wearable item 300 may be configured such that one or more flags may be attached to the garment for use in flag football. In some embodiments, wearable item 300 comprises connectors 304*a* and 304*b*, which may share some or all of the characteristics of connectors 110*a* and 110*b*, respectively, as described above with respect to FIG. 1A. In the embodiment depicted in FIGS. 3A-3C, connectors 304*a* and 304*b* comprise pockets located near waistband 302, which may be an elastic waistband located at or near a top edge of pants or shorts. In some embodiments, the pockets included in connectors 304*a* and 304*b* may be configured to securely hold one or more magnetic components, which may share one or more of the characteristics of magnetic component 114 as described above with respect to FIG. 1C. In some embodiments, a magnetic component secured in a pocket of connector 304*a* or 304*b* may constitute part of an adjustable magnetic connector assembly and may be used to adjustably magnetically attach flags to wearable item 300 in a similar manner as described above with respect to FIGS. 1A-1C and 2A-2B.

Figure 3D:
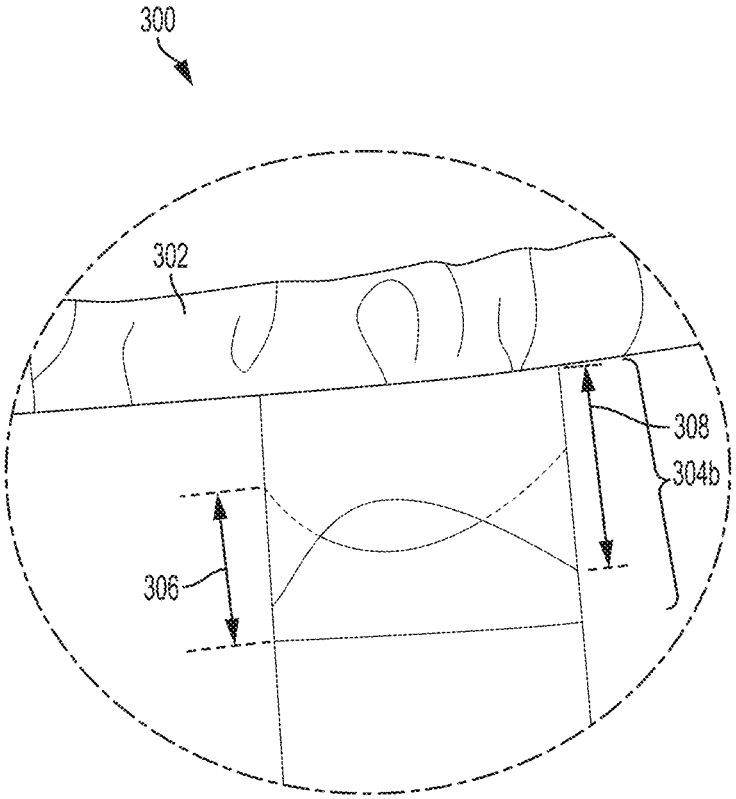
FIGS. 3D and 3E illustrate a connector of the wearable item in accordance with some embodiments.

FIG. 3D illustrates a side view of wearable item 300 with a highlighted view of connector 304*b*, which comprises a pocket on the side of a pair of pants in the illustrated embodiment, as explained above with reference to FIGS. 3A-3C. As shown in FIG. 3D, the pocket of connector 304*b* may include a lower flap 306 and an upper flap 308, each of which may be made of one or more fabrics, such as any one or more of the fabrics constituting the wearable item itself. Each of the flaps 306 and 308 may be sewn or otherwise secured to the garment along the vertical edges along the flap's sides. Upper flap 308 may be further sewn/secured to the garment along its upper edge, and lower flap 306 may be further sewn/secured to the garment along its lower edge. In some embodiments, the lower edge of top flap 308 and the upper edge of lower flap 306 may be free, not being sewn or otherwise secured to the fabric along the length of that edge. In some embodiments, the flaps 306 and 308 may overlap along all or part of their horizontal extent, as shown in the example in FIG. 3D. That is, the sum of the heights of the two flaps 306 and 308 may be greater than the height of the pocket itself, causing a portion of the flaps 306 and 308 to overlap along a center line of the pocket. In some embodiments, the overlap may be uniform (e.g., rectangular) in shape in the horizontal direction, while in other embodiments the flaps may include one or more curved or otherwise irregular shapes causing the overlap to be irregularly shaped or to only account for a partial span of the total width of the pocket.

In some embodiments, the pocket may be configured such that a magnetic component may be inserted into and securely stored in the pocket. In some embodiments, flaps 306 and 308 may be made of elastic material such that a magnetic component may be inserted into the pocket by stretching flap 306 and/or flap 308, and the magnetic component may be held in place by the force of the elastic flaps. In some embodiments, a magnetic component configured to be inserted into the pocket may have approximately the same dimensions as the pocket—for example, it may be the same width and the same height, or it may have a width and/or height that are less than 100% the width and/or height of the pocket but greater than 99%, 95%, 90%, 75%, 50%, or 25% the width and/or height of the pocket. A magnetic component that is the same size as a pocket, or that is only slightly smaller than a pocket, may be less likely to fall from the pocket or to slide around inside the pocket and cause unreliably and inconsistent magnetic force to be exerted on flag-side magnetic connector. In some embodiments, the pocket may be 1.5 inches in height and width with a 0.75 inch fabric overlap of flap 306 and flap 308.

Figure 3E:
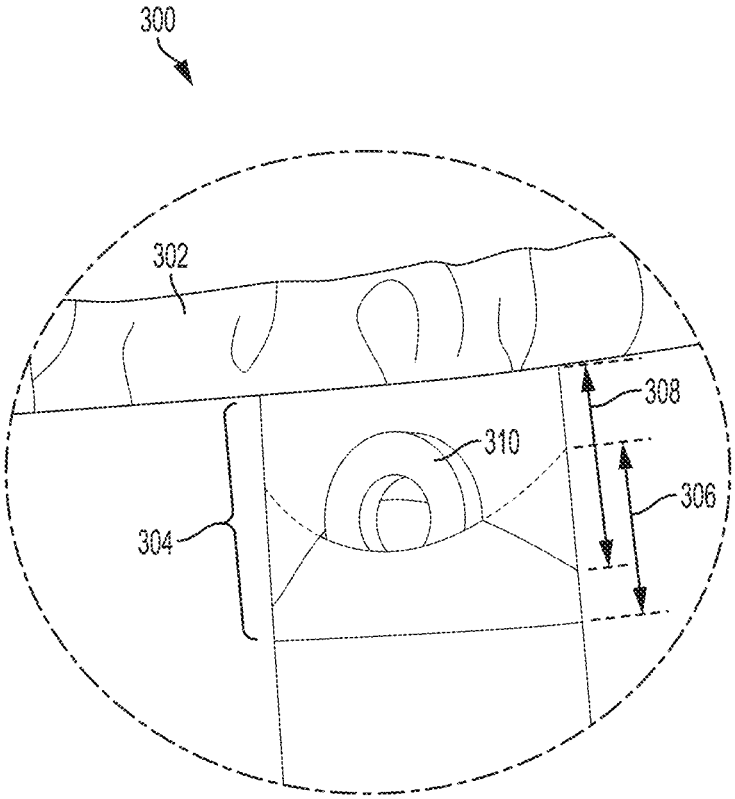

FIG. 3E illustrates a view of connector 304*b*, in accordance with some embodiments. In FIG. 3E, magnetic component 310 is shown being inserted into the pocket of connector 304*b*, such that it is partially tucked behind lower flap 306 but not yet tucked behind upper flap 308. Magnetic component 310 may share some or all of the characteristics of magnetic component 114 as described above with respect to FIG. 1C. By configuring a magnetic component such as magnetic component 306 to be removable from a wearable item or garment, the garment may be more easily and safely washed between uses, especially when the magnetic component includes or is coupled to electronics that may be damaged by water.

In some embodiments, a wearable item such as wearable item 300 may comprise one or more beltloops and/or tubes configured to receive a belt. For example, a tube of fabric may run substantially around the circumference of a pair of pants, wherein a belt may be threaded into and through a tube of fabric by being inserted into one of one or more openings in the tube of fabric. In some embodiments, the tube may have an outward-facing opening located near the hips of the pants, or at any other location where a flag is configured to be attachable to a belt that is inserted into the tube; this arrangement may be advantageous because the tube may provide secure attachment of the belt such that it may not easily be accidentally caught or grabbed, the small opening at the hip may provide a window for direct attachment of a flag to the belt such that a predefined configuration and orientation calling for direct attachment may be achieved, and the small opening may allow an official or player to easily visibly inspect the belt in order to see that the belt is being worn in the correct alignment and configuration (e.g., the part of the belt that attaches to the flag may be a different color than the rest of the belt, such that the different color may be visible through the window in the tube of the pants).

Figure 4:
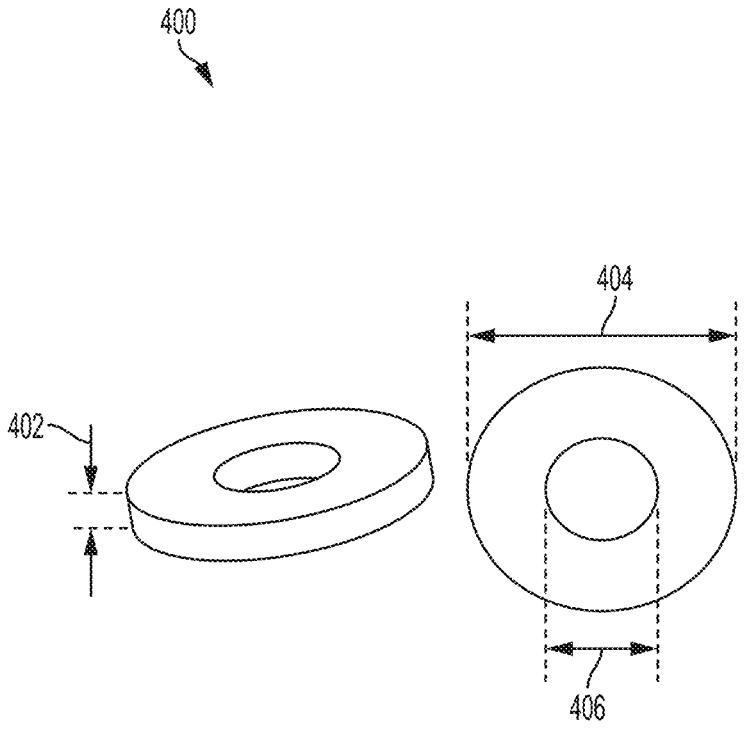
FIG. 4 illustrates a magnetic component of an adjustable magnetic connector in accordance with some embodiments.

FIG. 4 illustrates magnetic component 400, in accordance with some embodiments. Magnetic component 400 may share some or all of the characteristics of magnetic component 114 as described above with respect to FIG. 1C and/or of magnetic component 310 described above with respect to FIG. 3E.

In the illustrated embodiment, magnetic component 400 has circular prism shape with a circular-prism-shaped opening/hole centered in the middle of the circular face. In some embodiments, the diameter 404 of magnetic component 400 may be about 1.5 inches, about 1 inch, about 0.75 inches, or about 0.5 inches. In some embodiments, diameter 404 may be more than about 0.375 inches and less than about 0.75 inches. In some embodiments, the diameter of the circular opening 406 of magnetic component 400 may be about 1 inch, about 0.75 inches, about 0.5 inches, or about 0.25 inches. In some embodiments, the height/thickness 402 of magnetic component may be about 0.25 inches, about 0.2 inches, about 0.125 inches, or about 0.1 inches. In some embodiments, height/thickness 402 may be between about 0.05 inches and about 0.15 inches. In some embodiments, magnetic component 400 may be configured to lay flat inside a pocket, such as those described above with respect to FIGS. 3D and 3E, such that the component 400 protrudes from the side of a user's body by 0.25 inches or less, 0.2 inches or less, 0.125 inches or less, or 0.1 inches or less. By having a circular or disc shape and not protruding more than 0.25 inches or less from a side of a user's body, magnetic component 400 may be safe for use in flag football systems by virtue of being generally free of sharp corners or edges and by being relatively unobtrusive in not protruding far enough from a user's body to be easily caught on other players, equipment, or objects.

In some embodiments, a circular shape may be advantageous because it may allow one or more magnetic components to rotate without becoming misaligned from a predefined orientation in which a consistent magnetic attachment force will be exerted; that is, the predefined position and orientation may be independent of rotation of a magnetic component about at least one axis when the magnetic component is circular in shape.

In some embodiments, magnetic component 400 may comprise neodymium magnetic material, ceramic magnetic material, and/or rare-earth magnetic material. In some embodiments, a grade of magnetic material in magnetic component 400 may be between about 35 and 42.

Adjustable Magnetic Attachment Strengths

In some embodiments, a flag football system or set may include a plurality of sets of magnetic components that have various and/or varying different magnetic strengths. Magnetic components providing various and/or varying magnetic strengths may enable a flag football system to provide configurations of flags, belts, and wearable items in which flags are connected to belts and/or wearable items with user-selectable and adjustable magnetic attachment strengths. The ability to adjust magnetic attachment strengths may allow users to ensure that magnetic attachment strengths comply with league regulations and may allow for equipment to be flexibly used across various leagues and/or various users (e.g., children's leagues, adults' leagues, men's leagues, women's leagues) that may call for different standardized magnetic attachment forces for flags.

In some embodiments, a single magnetic component may be able to be magnetized to different magnetizations, such that the component may provide an adjustable magnetic attachment strength that achieves an adjustable magnetic attachment force when placed in a predefined attached orientation with a single corresponding magnetic component. As used herein, a magnetization of a magnetic component or material may refer to a magnetic flux output per unit volume of the magnetic component or material. Magnetic components having different grades may, in some embodiments, be expected to contain magnetic material having different measures of magnetic flux output per unit volume. As used herein, a magnetic strength of a magnetic component may refer to a magnitude of magnetic force exerted by the magnetic component accounting for the entire volume of the magnetic component.

In some embodiments, the adjustable magnetic attachment force may be adjusted in a system in which individual magnetic components have fixed magnetic strengths by replacing (or adding or removing) one or more magnetic components of the system with another magnetic component having a different fixed magnetic strength.

For example, a set of interchangeable flags, magnets, and belts/garments may have multiple sets of magnets configured such that each set of magnets has a different magnetic strength that is shared across all magnets in that set. If a user of the system desires to increase an adjustable magnetic attachment strength that is being implemented by the system, then the user may replace either (a) the set of magnets used in the flags or (b) the set of magnets used in the belts/garments with a stronger or weaker set of magnets, thereby adjusting the magnetic attachment strength for the flag-to-belt/garment connection. In some embodiments, magnets or magnetic components on the flag side only or on the belt/garment side only may be replaced, while in some embodiments magnets on both sides may be replaced.

In some embodiments in which magnets may be replaced to adjust an adjustable magnetic attachment strength, magnets may be removed from and attached to or inserted into connectors of flags or belts/garments. In general, the strength by which a magnet is attached to a belt/garment or flag may be greater than the magnetic attachment strength, such that pulling on a flag to remove it from a belt may remove the flag and its magnetic component from the belt/garment without inadvertently removing the flag's magnetic component from the flag itself. This consideration may be important in systems in which a magnetic component is magnetically attached to the flag itself—for example by being magnetically attached to a separate magnetic component (e.g., a magnetic or magnetized material) that is permanently integrated into a flag.

In some embodiments, an interchangeable magnetic component or magnet of an adjustable magnetic connector may be inserted into a housing or cartridge (e.g., as described above with respect to FIG. 2A), may be secured behind a fabric layer and optionally sewn partially or completely into place (e.g., as described above with respect to FIGS. 1B and 1C), or may be inserted into a pouch or pocket (e.g., as described above with respect to FIGS. 3D and 3E). In some embodiments, an interchangeable magnetic component or magnet of an adjustable magnetic connector may be attached to an exterior or exposed surface of a flag or belt/garment, such that the magnetic component is not secured behind a barrier and may directly contact and/or attach to other components of a connector, including other magnetic components. In some such embodiments, the interchangeable magnetic component may be attached via friction, suction, adhesive, hook-and-look fasteners, clasps, clips, buttons, snaps, magnetic force, or other suitable attachment means. In some such instances, as discussed above, the attachment force attaching the interchangeable magnetic component to the flag or belt/garment itself may be stronger than the magnetic attachment force by which the magnetic component is configured to attach to a magnetic component of a corresponding connector of the other item in a connector assembly.

In some embodiments, alternately or in addition to removing and replacing magnetic components in flags or in belts/garments, an adjustable magnetic attachment force may be adjusted by replacing a flag or belt/garment in its entirety with a different flag or a different belt/garment having one or more magnetic components with a stronger or weaker magnetic strength than the magnetic strength of one or more magnetic components of the replaced flag or belt/garment. In some such embodiments, magnetic components may be permanently or durably attached to respective flags or respective belts/garments, such that they are not configured to be easily removed and interchanged between different flags or belts/garments. In some such embodiments, different flags and/or different belts/garments may therefore be understood to correspond to different magnetic strengths. In some such embodiments, flags and/or belts/garments corresponding to different magnetic strengths may comprise a visual indicator of the strength to which they correspond, such as being marked with text or numerals or being color-coded to indicate the magnetic strength or relative magnetic.

In some embodiments, magnetic materials of one or more of grades N35, N40, V45, and/or N52 may be used in one or more of the connectors. In some embodiments, a diameter of one or more of the magnetic components may be between about 0.25 inches and about 1 inch, which a thickness of the one or more magnetic components may be between about 0.05 inches and 0.25 inches. In some embodiments, using these grades and these physical dimensions, magnetic attachment strengths of between about 0.08 pounds and about 33.7 pounds may be achieved.

Systems and Methods for Determining a Location

Figure 5:
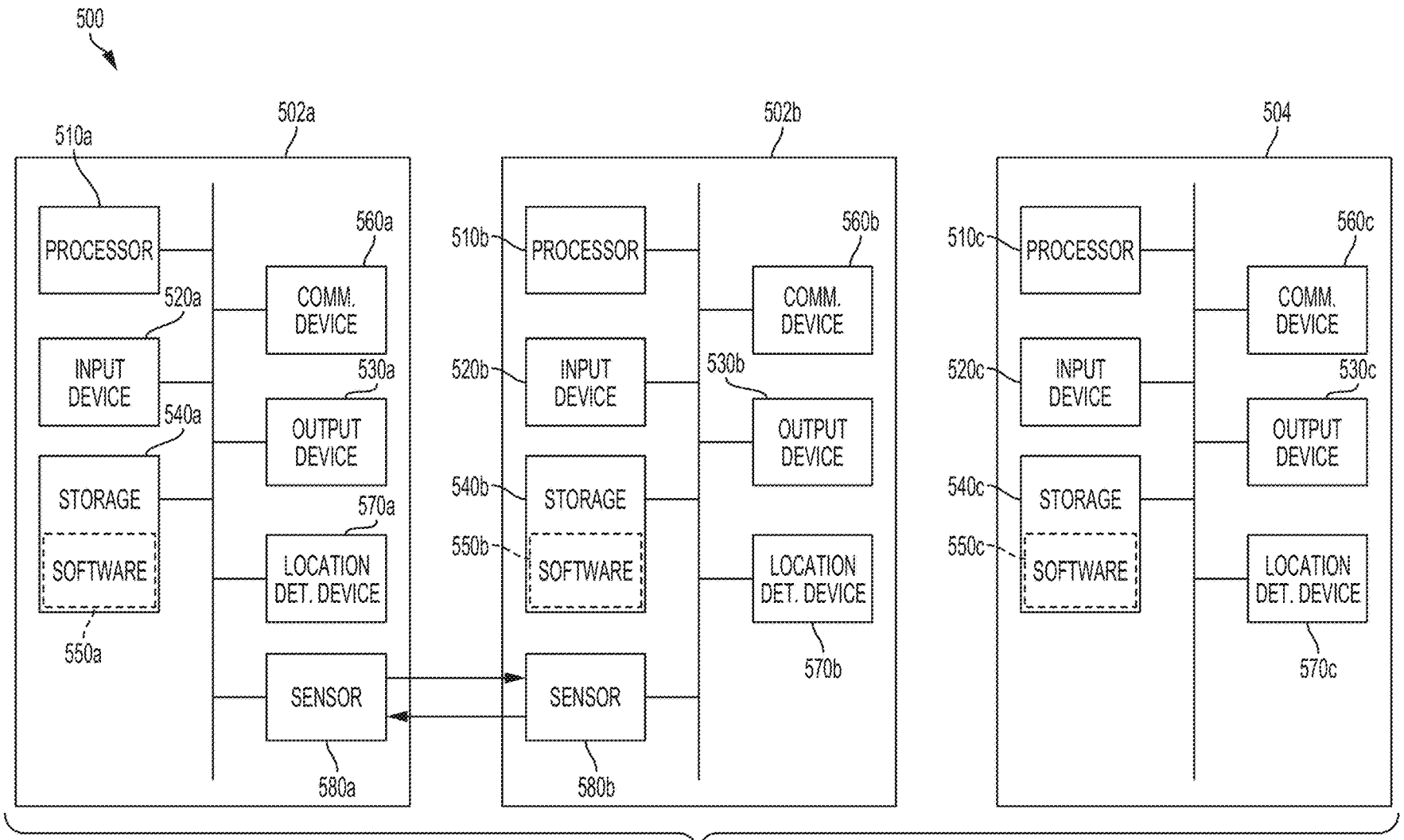
FIG. 5 illustrates a system for determining a location in flag football, in accordance with some embodiments.

FIG. 5 illustrates a system 500 for determining a location in flag football, in accordance with some embodiments. As described herein, a flag football system may be configured to automatically determine and indicate a location at which a flag was removed from a belt (or garment or wearable item), such that a location at which a ball should be spotted in a flag football game can be accurately and reliably determined. Computing components coupled to or included in connectors for the flags and belts may detect when contact between the connectors is broken and may store and/or generate a signal indicating that the location has been broken. A computing component located remotely or locally may then responsively determine a location of the flag and/or connector at the time when the contact was broken, and this location may be output to a display or other indicator to indicate, for example, a location at which the ball should be spotted for a subsequent play. This process will be described in further detail below.

In some embodiments, system 500 includes flag-side connector 502*a* and belt-side connector 502*b*. In some embodiments, connectors 502*a* and 502*b* may either or both share any one or more properties of connectors 108*a* and

108*b*, respectively, described above with respect to FIG. 1A, or with connectors 206 and 202, respectively, described above with respect to FIG. 2A.

In some embodiments, system 500 comprises remote computing device 504, which may be any computing device situated remotely from flag-side connector 502*a* and belt-side connector 502*b*.

In some embodiments, any one or more of connectors 502*a* and 502*b* and remote electronic device 504 may comprise one or more computing components that will be described further herein. In some embodiments, any one or more of these computing components may be the same or similar to any one or more computing components included in processing units 212 and/or 214 as described above with respect to FIG. 2A.

The processing units may in some embodiments be any suitable type of microprocessor-based device, such as a personal computer, workstation, server, or handheld computing device, such as a phone or tablet. The processing units can include, for example, one or more of a processor (510*a-c*), an input device (520*a-c*), an output device (530*a-c*), storage (540*a-c*), a communication device (560*a-c*), and a location determination device (570*a-c*). In some embodiments, the processing units of connectors 502*a* and 502*b* can include a sensor (580*a-b*).

Input devices 520*a*, 520*b*, and/or 520*c* can be any suitable devices that provide input, such as a touch screen or monitor, keyboard, mouse, or voice-recognition device. Output devices 530*a*, 530*b*, and/or 530*c* can be any suitable devices that provide output, such as a touch screen, display, monitor, light, haptic output device, printer, disk drive, or speaker.

Storage 540*a*, 540*b*, and/or 540*c* can be any suitable device that provides storage, such as an electrical, magnetic, or optical memory, including a RAM, cache, hard drive, CD-ROM drive, tape drive, or removable storage disk. Storage 540*a*, 540*b*, and/or 540*c* can be a non-transitory computer-readable storage medium comprising one or more programs, which, when executed by one or more processors, such as processors 510*a*, 510*b*, and/or 510*c*, cause the one or more processors to execute methods described herein, such as method 500.

Software 550*a*, 550*b*, and/or 550*c*, which can be stored in storage 540*a*, 540*b*, and/or 540*c* and executed by processors 510*a*, 510*b*, and/or 510*c*, can include, for example, the programming that embodies the functionality of the present disclosure (e.g., as embodied in the systems, computers, servers, and/or devices as described above).

Software 550*a*, 550*b*, and/or 550*c* can also be stored and/or transported within any computer-readable storage medium for use by or in connection with an instruction execution system, apparatus, or device, such as those described above, that can fetch and execute instructions associated with the software from the instruction execution system, apparatus, or device. In the context of this disclosure, a computer-readable storage medium can be any medium, such as storage 540*a*, 540*b*, and/or 540*c*, that can contain or store programming for use by or in connection with an instruction execution system, apparatus, or device.

Software 550*a*, 550*b*, and/or 550*c* can also be propagated within any transport medium for use by or in connection with an instruction execution system, apparatus, or device, such as those described above, that can fetch and execute instructions associated with the software from the instruction execution system, apparatus, or device. In the context of this disclosure, a transport medium can be any medium that can communicate, propagate, or transport programming for use by or in connection with an instruction execution system, apparatus, or device. The transport-readable medium can include, but is not limited to, an electronic, magnetic, optical, electromagnetic, or infrared wired or wireless propagation medium.

Communication devices 560*a*, 560*b*, and/or 560*c* can include any suitable devices capable of transmitting and receiving signals over a network, such as a network interface chip or card. The components of the computer can be connected in any suitable manner, such as via a physical bus or wirelessly.

Location determination devices 570*a*, 570*b*, and/or 570*c* can include any sensor, receiver, input device, processor, memory, communication device, or combination thereof configured to determine a location and to generate and store and/or transmit data indicative of that determined location. For example, location determination devices 570*a*, 570*b*, and/or 570*c* may comprise a GPS receiver, a cellular communication device, a Bluetooth communication device, an RFID communication device, and/or a camera-based system for visual tracking of targets. In some embodiments, as explained further below, location determination devices 570*a*, 570*b*, and/or 570*c* may determine, in response to detecting that contact between connectors 502*a* and 502*b* has been broken, a location at which one or more of the sensors was location at the time that the contact was broken.

Sensors 580*a* and/or 580*b* can be any suitable sensor or combination of sensors configured to detect whether connector 502*a* and connector 502*b* are connected to one another, or whether they are in proximity to one another, or whether the connectors change from connected to disconnected, and/or whether the connectors change from disconnected to connected. In some embodiments, sensors 580*a* and/or 580*b* may comprise a proximity sensor such as an IR sensor or camera-based sensor, configured to detect whether a connector or other sensor is in proximity to the sensor. In some embodiments, sensors 580*a* and/or 580*b* may comprise a pressure sensor configured to detect whether a connector or other object is exerting pressure or force on the sensor. In some embodiments, sensors 580*a* and/or 580*b* may comprise one or more electrical circuits that are completed when connectors 502*a* and 502*b* are in contact with one another in a predefined position and/or orientation, such that sensors 580*a* and/or 580*b* may detect when the circuit is broken and may thereby determine that the connectors have been separated. In some embodiments, sensors 580*a* and/or 580*b* may comprise one or more data interfaces for sending electronic signals to indicate that connectors 502*a* and 502*b* are in contact with one another, such as a wireless communication interface configured to send periodic pings between the connectors and to detect and alarm when the connectors are further than a predefined distance (such as a maximum communication range of the wireless communication interface) from one another. In some embodiments, in addition to or in place of sensors 580*a* and/or 580*b*, remote video analysis may be used to automatically analyze one or more images or video frames in order to determine when a flag has been removed from a belt or garment.

In some embodiments, one or both of sensors 580*a* and/or 580*b* may be a sensor configured to detect a magnetic field. In some such embodiments, the flag and belt/garment may be attached by a connector other than a magnetic connector, because a magnetic force exerted from a magnetic portion of one or more of the connectors may interfere with the sensor and cause unreliable readings. For example, if a sensor configured to detect the presence of a magnet is located in a connector of a flag, then the sensor may detect a magnetic component located in the belt, and may cease to detect the magnetic component in the belt when the flag is pulled from the belt, and the system may therefore determine that the flag has been detached. However, if a magnetic portion of a magnetic connector is also located in the flag itself, then the sensor in the flag may be unable to reliably detect the absence of the magnetic field generated by the magnetic portion in the belt, because the sensor will always be proximate to the magnetic portion in the flag, even when the flag is removed. Accordingly, in some embodiments, a sensor in a flag connector may be configured to detect a magnetic field of a magnetic portion in the belt/garment connector, and there may be no magnetic portion in the flag connector; conversely, in some embodiments, a sensor in a belt/garment connector may be configured to detect a magnetic field of a magnetic portion in a fag connector, and there may be no magnetic portion in the belt/garment connector. In some such embodiments, an attachment force may be provided by a mechanical connection, a friction-based connection, a suction-based connection, and/or a hook-and-loop fastener based connection, rather than by a magnetic force.

Figure 6:
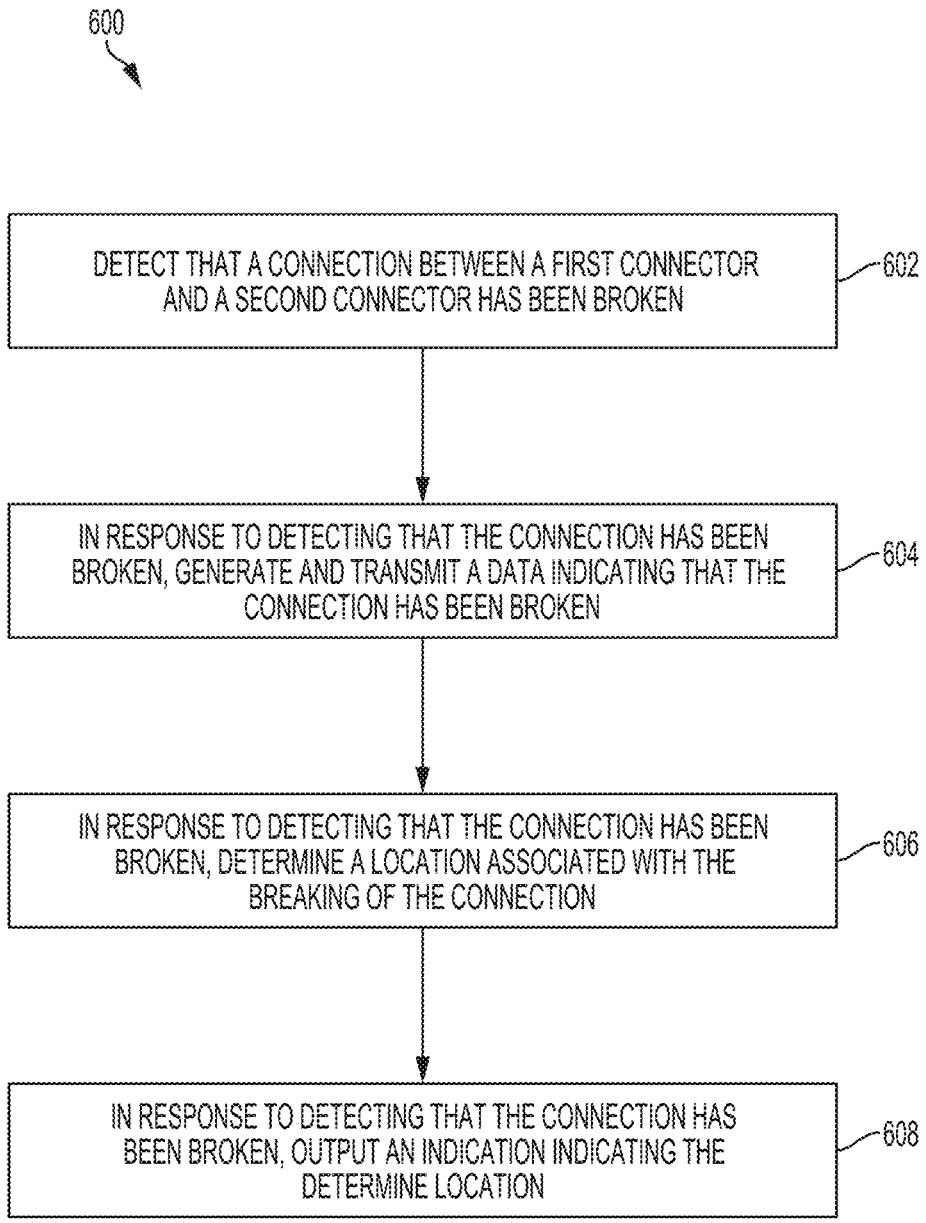
FIG. 6 illustrates a flowchart depicting a method of determining a location in flag football, in accordance with some embodiments.

FIG. 6 illustrates a flowchart depicting a method 600 of determining a location in flag football, in accordance with some embodiments. In some embodiments, all or part of method 600, alone or in combination with other techniques disclosed herein, may be performed by one or more computerized systems. In some embodiments, transitory or non-transitory computer-readable media may store instructions that cause one or more computerized systems to perform all or part of method 600, alone or in combination with other techniques disclosed herein. In some embodiments, method 600 may be performed by one or more of the components of system 500 as described above with reference to FIG. 5.

At step 602, in some embodiments, the system may detect that a connection between a first connector and a second connector has been broken. In some embodiments, an input or signal received by any one or more sensors of the system may cause one or more processors of the system to determine that the connection has been broken.

In some embodiments, a proximity sensor (e.g., IR sensor, laser-based sensor, or camera-based sensor) of one detector may detect that another detector is not within a predetermined distance of the first sensor, or that the other sensor is not in a predetermined location and/or orientation with respect to the first sensor, and may thereby determine that the connection between the connectors has been broken.

In some embodiments, a pressure sensor of one sensor may determine that pressure is not being exerted on the pressure sensor in such a manner that another connector would exert pressure on the sensor if the connectors were connected, and the system may thereby determine that the connection between the connectors has been broken.

In some embodiments, a sensor configured to detect one or more electrical signals may determine that a circuit is not completed, wherein the connectors may be configured such that, when connected in a predefined position and/or orientation, the circuit will be completed. For example, the connectors may be configured such that, when connected, physical contact between the sensors allows electrical current to flow to, from, and/or between the two sensors by way of physical conduct of conductive elements; a sensor in one of the connectors may accordingly receive and detect the presence of one or more electrical signals only when the connectors are in physical contact with one another and/or in a predefined position and/or orientation with respect to one another. In accordance with a determination that one or more circuits are not completed, the system may thereby determine that the connection between the connectors has been broken.

In some embodiments, a magnetic sensor of one connector may be configured to determine whether a magnetic field or magnetic force created by a magnetic component of another sensor is detected and may accordingly determine whether the connectors are connected. For example, the sensor may be configured such that it may recognize a predefined magnetic force and/or a predefined magnetic field exerted on the sensor by the magnetic component of the other connector when the connectors are connected to one another in a predefined position and/or orientation with respect to one another. Thus, if the predefined magnetic force and/or a predefined magnetic field are not detected as being exerted on the sensor, the system may thereby determine that the connection between the connectors has been broken.

In some embodiments, a sensor including one or more receivers configured to receive wireless signals may determine a position of one or both connectors relative to one another based on the received wireless signals, and may determine, based on the received position data, whether the connectors are in contact with one another, in a predefined position with respect to one another, and/or in a predefined orientation with respect to one another. If it is determined that the connectors are not in contact with one another, in a predefined position with respect to one another, and/or in a predefined orientation with respect to one another, then the system may thereby determine that the connection between the connectors has been broken.

In some embodiments, the determination as to whether the connection between the connectors has been broken may be made by a processor located in the same connector as the sensor receiving the data relied on to make the determination, by a processor located in a different connector from the sensor receiving the data relied on to make the determination, and/or by a processor located in neither connector, such as a processor located in a remote electronic device, in a server, in the cloud, or in any computer network with which one or more of the sensors is configured to communicate.

In the example of FIG. 5, one or both of sensors 580*a* and 580*b* may receive data and/or input in accordance with one or more of the above embodiments and may transmit a signal to one or more of processors 510*a*, 510*b*, and/or 510*c* in accordance with the received data and/or input. One or more of the sensors may then make any one or more of the determinations explained above to determine that a connection between connectors 502*a* and 502*b* has been broken. In the example of FIG. 2A, when a circuit running through contact element 204 is broken, one or more sensors located in processing units 212 and/or 214 may detect that the circuit is not completed, and one or more processors located in processing units 212 and/or 214 may determine that the connection between connectors 202 and 206 has been broken.

At step 604, in some embodiments, in response to detecting that the connection has been broken, the system may generate and transmit data indicating that the connection has been broken. In some embodiments, transmitting the data may comprise sending data to a local storage or memory to be stored, while in some embodiments transmitting the data may comprise sending the data to a remote computing device to be processed, stored, or further transmitted. In some embodiments, transmitting the data may comprise transmitting the data to a one or more processors, located either locally or remotely, that may cause one or more additional steps to be undertaken in response to receiving and/or verifying the data, such as determining a location corresponding to the connection being broken in accordance with receiving the data.

In the example of FIG. 5, one or more of processors 510*a*, 510*b*, and/or 510*c* may transmit data to one or more of storage 540*a*, 540*b*, and/or 540*c* for storage. In some embodiments, if the determination that contact has been broken is made by one of processors 510*a* or 510*b*, the connector-based processor may transmit (e.g., via communication devices 560*a* or 560*b*) data such that further steps may be taken in accordance with the data. For example, as will be explained further below, in some embodiments, the data or a related signal may in some embodiments be transmitted to one or more of location determination devices 570*a*, 570*b*, and/or 570*c* such that a location can be determined that corresponds to the connection being broken.

At step 606, in some embodiments, in response to detecting that the connection has been broken, the system may determine a location associated with the breaking of the location. Alternately or additionally, the system may perform this step in response to receiving data or a signal indicating or corresponding to the determination that the connection has been broken. In some embodiments, the determined location is a location of one or more objects at a time at which the system determines the connection to have been broken. In some embodiments, the location may be the location of a first connector, the location of a second connector, the location of a player wearing a flag and/or belt associated with the connectors, the location of a ball associated with the flag football game, or any combination of these locations or other locations, or an average or midpoint location calculated from any one or more of them.

In some embodiments, a sensor in a connector may receive input, and a processor in communication with the sensor may determine, based on the input, that contact has been broken between the connector and another connector. In response to determining that the contact has been broken, the processor and/or another associated processor may immediately determine a location of the sensor, such as by using one or more GPS devices, one or more image-based and/or video-based visual tracking devices, and/or one or more RFID devices. Exemplary systems that may be used to determine a location in a flag football game in accordance with method 600 may include Catapult OptimEye, SMT OASIS, FitStats Technologies AthleteMonitoring, Fusion Sports Smartspeed, and/or others.

In some embodiments, a location determination is made immediately in response to determining that the contact has been broken, or immediately in response to receiving a signal indicating as much. In some embodiments, the location determined may be an absolute geographic location, and, in some embodiments, the location determined may be a location relative to one or more components of a flag football system and/or a flag football field, such as fixed antennas, pylons, or other location markers.

In some embodiments, a location is determined that is associated with a predefined point in time, such as a point in time at which it is determined that the contact was broken. For example, a system may determine a time at which the connection is determined to have been broken and may then look up location data associated with that time and determine that the associated location data is the location associated with the breaking of the contact, as an estimation of the location of the connector (or other element) at the time the location was broken. In this way, a system that continuously tracks location may look up a location that was stored at a past time and output the location when a signal indicating that past time is received, such that inaccuracy due to lag or latency in the time it takes for signals to be transmitted and data to be processed may be minimized. This may allow for more accurate and reliable location data to be generated and output and for a spot determined in a flag football game to be more accurate.

In the example of FIG. 5, one or more of processors 510*a*, 510*b*, and/or 510*c* may determine a location associated with one or both of connectors 502*a* and 502*b*. For example, in response to receiving a signal via communication device 560*c* indicating that the connection between connectors 502*a* and 502*b* has been broken, processor 510*c* may determine a location of one or both of connectors 502*a* and 502*b*, such as by consulting stored location tracking data corresponding to one of the connectors or by polling or otherwise receiving input data via location determination device 570*c*, such as RFID data, image data, or GPS data, indicative of a position of one of the connectors. Alternately, in response to determining that the connection between connectors 502*a* and 502*b* has been broken, one of processors 510*a* and 510*b* may communicate with location determination device 570*a* or 570*b*, respectively, to determine a location of the associated connector. For example, the location device may receive GPS signals indicating a current geographic location of the associated connector and may determine the geographic location to be the location at which the contact was broken.

At step 608, in some embodiments, in response to detecting that the connection has been broken, the system may output an indication indicating the determined location. For example, the system may be configured to output one or more visual or audible signals indicating a yard-line, a position on a field in one or both of the length-direction and the width-direction, a position relative to a fixed location or position marker, and/or a geographic position. For example, a display associated with the system may display an indication of a yard-line on a flag football field at which the connection was determined to be broken, such that players or officials may place the ball at that location in advance of the next play. In some embodiments, the location may be displayed by text, graphic representation, and/or other visual representation on a display of an electronic device such as a smart-phone, tablet, other portable electronic device, monitor, scoreboard, and/or video board. In some embodiments, the location may be audibly indicated by one or more speakers associated with the system.

In the embodiment of FIG. 5, one or more of output devices 530*a*, 530*b*, and 530*c* may display or audibly indicate the determined location. For example, a display or visual indicator integrated into sensor 502*a*, sensor 502*b*, or remote electronic device 504 may display the determined location. In some embodiments, device 504 may be a portable electronic device carried by an official or player in the flag football game, and the official or player may be able to consult the displayed or indicated location on the electronic device in order to determine where to spot the ball before a subsequent play or to determine whether a first down or touchdown has been achieved or to determine whether a player was out of bounds before the connection was broken.

In some embodiments, the system may output a generalized indication that a connection has been broken, such as by causing one or more lights to light up or by causing one or more audible indications to be outputted. For example, when the system detects that a connection has been broken (e.g., a flag has been detached from a belt), one or more lights (e.g., an LED) included in or associated with one or more of output devices 530*a*, 530*b*, and 530*c* may configured to to light up, and/or one or more speakers associated with one or more of output devices 530*a*, 530*b*, and 530*c* may be caused to generate an audible output indicating that the flag has been detached. In some embodiments, the output may generally indicate that any one or more connections in the system has been broken (e.g., any one or more flags has been detached from a corresponding belt), while in some embodiments the output may specifically indicate which connection has been broken (e.g., specifically which flag and/or which belt has been detached).

In some embodiments, an indication that a connection has been broken may be output by one or more lights and/or speakers and/or other output devices disposed on a belt/garment and/or on a flag. In some embodiments, when a connection is broken between a flag and a belt, then one or more lights on the belt may be caused to light up so that players and referees can immediately identify that the player has been downed; alternately or additionally, a speaker on the belt may be caused to output a noise in response to the connection being broken so that all players and referees can know that the play has ended and that play should stop. In some embodiments, the lights are positioned on the flag or belt in a plurality of positions so that the the illumination of the lights can be seen regardless of the direction that the player is facing. In some embodiments, the belt/garment/and or flag includes at least two lights, at least three lights or at least four lights positioned around a player. In some embodiments at least four indicator lights are used so that the front, back and sides of a player can be illuminated.

In some embodiments, an output device may include a small light and/or speaker sewn into a belt/garment or sewn into a flag, and/or a light and/or speaker integrally formed as part of a connector of the belt/garment or flag. In some embodiments, an output device may include an illuminatable strip that includes one or more light elements, such as a flexible strip of LED light elements or a length of electroluminescent wire that may be sewn into or worn over a belt and/or wasteband. In some embodiments, multiple illuminating output devices, such as a strip of LED lights, on a player's body may enable players and referees to see the output generated by the multiple lights from any angle and regardless of the direction in which the player is facing. The illumination strip can allow illumination of the player in at least 180 degrees, at least 270 degrees or 360 degrees around a player. In some embodiments, the output device may be connected to one or more power sources (e.g., batteries) worn on the player's body.

In some embodiments, in addition to the determined location, the system may also output other information associated with the breaking of the contact, such as a time on a remaining on a game clock associated with the breaking of the contact. In some embodiments, the system may be further configured to automatically control a game clock in accordance with the determination that the connection has been broken, such as being configured to automatically stop the game clock in certain in-game situations when it is determined that the connection is broken and the play is therefore over. In some embodiments, the system may be further configured to determine when a flag has been detached erroneously, such as before the start of a play or away from a location of the ball during a play, and to generate one or more alerts accordingly. In some embodiments, the system may be further configured to automatically use one or more of the location-determination techniques disclosed herein to determine the location of players in order to determine whether players are onsides or offsides before the snap of the ball, and/or to determine additional information about legal or illegal formation in the game, and to generate one or more alerts regarding this information and convey it to officials or players.

In some embodiments, the system may be configured to generate outputs (e.g., by lights or speakers) indicating additional information about the game. For example, in some embodiments, one or more output devices (e.g., a light and/or speaker) disposed on or associated with a belt/garment or flag may be configured to generate an output indicating that a play is live, that a play is dead, that a playclock has or has not expired, that a time has or has not elapsed after which is is legal to rush a quarterback, and/or that a time has or has not elapsed before which a quarterback is required to throw the football.

Figure 7:
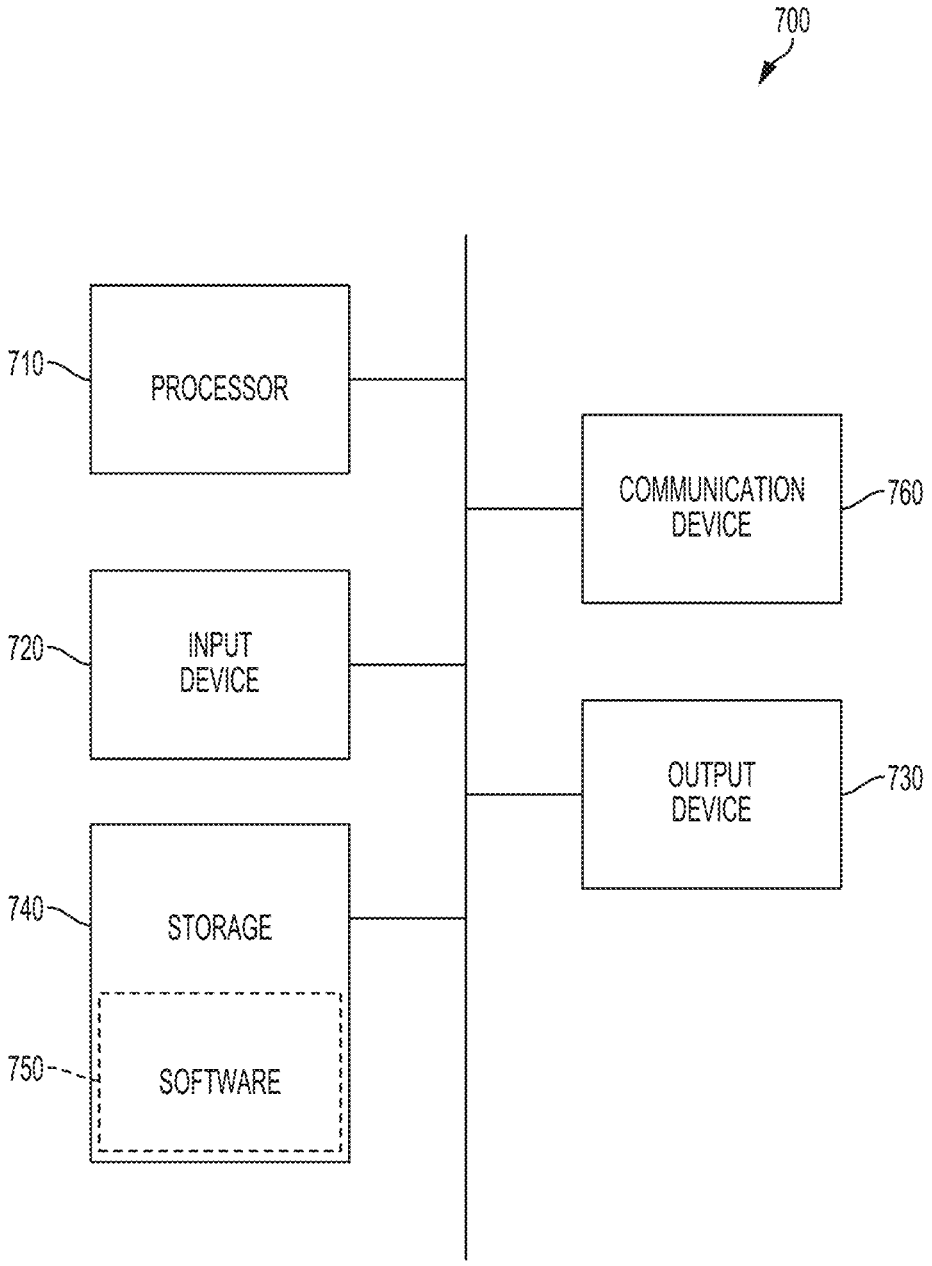
FIG. 7 illustrates a computer, in accordance with some embodiments.

FIG. 7 illustrates an example of a computer in accordance with one embodiment. Computer 700 can be a component of a system for determining a location in flag football, such as system 500 described above with respect to FIG. 5. In some embodiments, computer 700 is configured to execute a method for determining a location, such as all or part of method 500.

Computer 700 can be a host computer connected to a network. Computer 700 can be a client computer or a server. As shown in FIG. 7, computer 700 can be any suitable type of microprocessor-based device, such as a personal computer, workstation, server, or handheld computing device, such as a phone or tablet. The computer can include, for example, one or more of processor 710, input device 720, output device 730, storage 740, and communication device 760.

Input device 720 can be any suitable device that provides input, such as a touch screen or monitor, keyboard, mouse, or voice-recognition device. Output device 730 can be any suitable device that provides output, such as a touch screen, monitor, printer, disk drive, or speaker.

Storage 740 can be any suitable device that provides storage, such as an electrical, magnetic, or optical memory, including a RAM, cache, hard drive, CD-ROM drive, tape drive, or removable storage disk. Communication device 760 can include any suitable device capable of transmitting and receiving signals over a network, such as a network interface chip or card. The components of the computer can be connected in any suitable manner, such as via a physical bus or wirelessly. Storage 740 can be a non-transitory computer-readable storage medium comprising one or more programs, which, when executed by one or more processors, such as processor 710, cause the one or more processors to execute methods described herein, such as all or part of method 500.

Software 750, which can be stored in storage 740 and executed by processor 710, can include, for example, the programming that embodies the functionality of the present disclosure (e.g., as embodied in the systems, computers, servers, and/or devices as described above). In some embodiments, software 750 can include a combination of servers such as application servers and database servers.

Software 750 can also be stored and/or transported within any computer-readable storage medium for use by or in connection with an instruction execution system, apparatus, or device, such as those described above, that can fetch and execute instructions associated with the software from the instruction execution system, apparatus, or device. In the context of this disclosure, a computer-readable storage medium can be any medium, such as storage 740, that can contain or store programming for use by or in connection with an instruction execution system, apparatus, or device.

Software 750 can also be propagated within any transport medium for use by or in connection with an instruction execution system, apparatus, or device, such as those described above, that can fetch and execute instructions associated with the software from the instruction execution system, apparatus, or device. In the context of this disclosure, a transport medium can be any medium that can communicate, propagate, or transport programming for use by or in connection with an instruction execution system, apparatus, or device. The transport-readable medium can include, but is not limited to, an electronic, magnetic, optical, electromagnetic, or infrared wired or wireless propagation medium.

Computer 700 may be connected to a network, which can be any suitable type of interconnected communication system. The network can implement any suitable communications protocol and can be secured by any suitable security protocol. The network can comprise network links of any suitable arrangement that can implement the transmission and reception of network signals, such as wireless network connections, T1 or T3 lines, cable networks, DSL, or telephone lines.

Computer 700 can implement any operating system suitable for operating on the network. Software 750 can be written in any suitable programming language, such as C, C++, Java, or Python. In various embodiments, application software embodying the functionality of the present disclosure can be deployed in different configurations, such as in a client/server arrangement or through a Web browser as a Web-based application or Web service, for example.

The foregoing description, for purpose of explanation, has been described with reference to specific embodiments. The illustrative embodiments described above, however, are not intended to be exhaustive or to limit the disclosure to the precise forms disclosed. Many modifications and variations are possible in view of the above teachings. The embodiments were chosen and described to best explain the principles of the disclosed techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims.

The invention claimed is:

1. A method for monitoring flag football equipment, comprising:

detecting, by one or more processors, that contact between a first connector associated with a flag and a second connector associated with a wearable item has been broken;

wherein the first connector comprises a first magnetic portion and the second connector comprises a second magnetic portion; and in response to detecting that the contact has been severed, outputting an indication indicating a location associated with the breaking of the connection of the first connector and the second connector.

2. The method of claim 1, further comprising, in response to detecting that the contact has been broken, generating and transmitting a signal indicating that the contact has been broken.

3. The method of claim 1, further comprising:

determining the location associated with the breaking of the connection of the first connector and the second connector, in response to detecting that the contact has been severed.

4. The method of 1, wherein:

before contact between the first connector and the second connector is broken:

the first connector and the second connector are magnetically attached by a magnetic attachment force exerted between the first magnetic portion and the second magnetic portion; and the first connector and the second connector are in electrical contact with one another; and detecting that contact between the first connector and the second connector has been broken comprises detecting that the electrical contact has been broken.

5. The method of claim 1, further comprising, in response to detecting that the contact has been broken, outputting an indication that the contact has been broken.

6. The method of claim 5, wherein outputting an indication that the contact has been broken comprises causing one or more output devices associated with one or more of the flag and the wearable item to illuminate.

7. The method of claim 3, wherein determining the location associated with the breaking of the connection of the first connector and the second connector comprises receiving an indication of the location from a location sensor.

8. The method of claim 3, wherein determining the location associated with the breaking of the connection comprises determining a location of one or both of the first connector and the second connector at a time of the breaking of the connection.

9. The method of claim 3, wherein determining the location associated with the breaking of the connection comprises determining a geospatial location.

10. The method of claim 1, wherein:

the first connector is provided as part of the flag; and the second connector is proved as part of the wearable item.

* * * * *